US006053782A

United States Patent [19]

Jordan

[11] Patent Number: 6,053,782

[45] Date of Patent: Apr. 25, 2000

[54] AIRBOAT TRANSMISSION, LUBRICATION SYSTEM, AND ASSOCIATED METHOD

[75] Inventor: W. Bishop Jordan, Maitland, Fla.

[73] Assignee: Louis A. Bell, Rockledge, Fla.

[21] Appl. No.: 09/133,583

[22] Filed: Aug. 13, 1998

[51] Int. Cl.[7] ..... B63H 23/00

[52] U.S. Cl. ..... 440/75; 440/37; 416/129

[58] Field of Search ..... 440/75, 37, 79, 440/80, 81, 86; 416/128, 129; 74/664, 665 A, 665 D

[56] References Cited

U.S. PATENT DOCUMENTS

| | | | |
|---|---|---|---|
| 1,329,387 | 2/1920 | Fay . | |
| 1,734,268 | 11/1929 | Moorhouse . | |
| 1,842,055 | 1/1932 | Stout . | |
| 2,228,638 | 1/1941 | Mercier | 416/128 |
| 2,244,763 | 6/1941 | Bugatti . | |
| 2,380,952 | 8/1945 | Dewey . | |
| 2,525,708 | 10/1950 | Morris . | |
| 2,531,032 | 11/1950 | Desmoulins . | |
| 2,584,115 | 2/1952 | Dinsmoor . | |
| 3,500,784 | 3/1970 | Reynolds . | |
| 3,991,629 | 11/1976 | Dearnley . | |
| 4,127,080 | 11/1978 | Lakiza et al. . | |
| 4,392,839 | 7/1983 | Aucktor . | |
| 4,421,489 | 12/1983 | Van Veldhuizen . | |
| 4,426,049 | 1/1984 | Stewart . | |
| 4,527,978 | 7/1985 | Zackrisson . | |
| 4,820,241 | 4/1989 | Nakamura . | |
| 4,826,458 | 5/1989 | Irwin et al. . | |
| 4,932,280 | 6/1990 | Becker et al. . | |
| 5,030,148 | 7/1991 | Fujita | 440/75 |
| 5,090,869 | 2/1992 | Wright . | |

FOREIGN PATENT DOCUMENTS 62131 11/1913 Germany .

*Primary Examiner*—Jesus D. Sotelo
*Attorney, Agent, or Firm*—Allen, Dyer, Doppelt, Milbrath & Gilchrist, P.A., Attorney at Law

[57] ABSTRACT

A gear-based airboat transmission is provided for driving a pair of coaxial, counter-rotating propellers. The transmission includes a fore output gear rotatably affixable within a housing and affixable to the inner shaft for rotating the outer propeller. An aft output gear is rotatably affixable within the housing and is affixable to the outer shaft coaxial with the inner shaft for rotating the inner propeller opposite the outer. The aft output gear is generally coaxial with the fore output gear. An intermediate gear shaft has a fore end and an aft end, and both ends are opposedly and rotatably affixable within the housing. This bracing confers additional stability to the transmission, conferring longer life and decreased vibration. An intermediate gear is mounted thereon, and is positioned in driving relation to the fore output gear. A drive gear is rotatably affixable within the housing and is affixed for corotation with a drive shaft. The drive gear has a fore portion that is positioned in driving relation to the intermediate gear and an aft portion that is positioned in driving relation to the aft output gear. Improved stability characteristics are imparted by supporting the drive shaft at two points within the case and also by positioning the drive and the output shafts in vertical alignment. The adaptability of the gear-based transmission to being coupled with an automobile engine confers improved noise and efficiency characteristics.

25 Claims, 5 Drawing Sheets

AIRBOAT TRANSMISSION, LUBRICATION SYSTEM, AND ASSOCIATED METHOD

BACKGROUND OF THE INVENTION

1. Field of the Invention

The present invention relates to airboat propulsion mechanisms and, more particularly, to gear-based transmissions for airboats.

2. Description of Related Art

Airboats are often driven over land and water at high speeds. Airboats typically have employed aircraft engines operating at approximately 2500–3000 revolutions per minute (rpm) connected to solid direct-drive shafts, which rotate a single propeller. Aircraft engines are extremely expensive, and it is a general practice therefore to mount a used aircraft engine to an airboat to save on costs.

The steering apparatus of an airboat usually comprises a pair of rudders, with trim tabs added to correct for the torque that results from the rotation of the propeller, this torque tending to keep the boat from maintaining a level attitude.

Extreme gyroscopic forces can occur when airboats are turned rapidly, and these forces are borne, among other structures, by the driven shaft.

Previously known airboat systems utilize belt-driven transmissions, which are inefficient owing to power losses caused by belt friction, especially at higher rotational velocities. Belt breakage in these systems is a source of failure. Another disadvantage of belt-driven systems is their inability to permit reduction of propeller speed, since the driven shaft used to effect such a reduction would have to be too small to be practicable. Thus it would be advantageous to utilize a different transmission method in an airboat to enable engine speed reduction without loss of efficiency.

Propeller breakage is also a major source of failure, since at 3000 rpm extremely high forces are experienced at the propeller hub. It would therefore be desirable to reduce the load on the propeller.

It has been taught by Becker et al. (U.S. Pat. No. 4,932,280, dated Jun. 12, 1990) to use coaxial drive shaft systems for driving multiple outputs from a single input in an aircraft. Gearing means are disclosed for driving two outputs at different speeds.

The use of a gear-based transmission for airboats has been taught by Kaye (U.S. Pat. No. 5,807,149), including a transmission for driving a pair of counter-rotating coaxial shafts, to each of which is affixed a propeller. Such an arrangement can be used with an automobile engine, which is far more economical than an aircraft engine. This transmission has been shown to reduce noise and torque, to permit varying gear ratios, to increase fuel efficiency and engine life, and to be less expensive to operate.

An improved gear-based transmission for airboats has also been disclosed by Jordan (U.S. Pat. No. 5,724,867, the entire disclosure of which is incorporated herein by reference).

SUMMARY OF THE INVENTION

It is an object of the present invention to provide an airboat transmission that has improved strength, efficiency, noise, and stability characteristics for driving a pair of counter-rotating propellers.

It is a further object to provide such an airboat transmission having a minimum number of gears for driving two coaxial counter-rotating shafts.

It is another object to provide such an airboat transmission having a compact configuration to optimize space utilization.

It is an additional object to provide such an airboat transmission having reduced weight.

These and other objects are achieved by the airboat transmission of the present invention, which is for driving a pair of coaxial, counter-rotating propellers.

When the transmission is in use on an airboat, a drive shaft is mated at one end to a motor crank extending from and rotated by an engine. The opposite end of the drive shaft extends into the transmission from the fore side. As mentioned above, previously known airboats utilized aircraft-type engines; however, with the transmission of the present invention, it has been found that an automobile engine can be used. This has a benefit of reducing cost, as well as other benefits to be discussed below.

An inner shaft also extends into the interior space of the housing, typically from the aft side. The inner shaft is for rotating an outer propeller, that is, the propeller farther from the airboat body.

A hollow outer shaft likewise extends into the interior space of the housing and is further positioned in surrounding, generally coaxial arrangement to the inner shaft. The outer shaft is shorter than the first, and both ends protrude beyond the ends of the inner shaft. This outer shaft is for rotating an inner propeller, that is, the propeller closer to the airboat body.

The transmission of the present invention comprises a fore output gear rotatably affixable within a housing and affixable to the inner shaft for rotating the outer propeller in a first direction. An aft output gear is rotatably affixable within the housing and is affixable to the outer shaft coaxial with the inner shaft for rotating the inner propeller in a second direction opposite the first direction. The aft output gear is generally coaxial with the fore output gear.

An intermediate gear shaft has a fore end and an aft end, and both ends are opposedly affixable for rotation within the housing. This bracing on both ends confers additional stability to the transmission, conferring longer life and decreased vibration. An intermediate gear is mounted on the intermediate gear shaft, and is positioned so that the intermediate gear is in driving relation to the fore output gear.

A drive gear is rotatably affixable within the housing and is affixed for corotation with the drive shaft. The drive gear has a fore portion that is positioned in driving relation to the intermediate gear and an aft portion that is positioned in driving relation to the aft output gear. In a particular embodiment, the drive gear further has a central portion that has a diameter smaller than a diameter of the fore and the aft portions, and the central portion is positioned axially between the fore and the aft portions and further is radially coplanar with and in spaced relation to the fore output gear.

Also in this particular embodiment, the intermediate gear is positioned axially in spaced relation from the aft output gear and the aft drive gear.

The rotation of the drive shaft in one direction achieves, owing to the interposition of the intermediate gear between the drive gear and the fore output gear, a counter-rotation of the two output shafts and thus imparts counter-rotation to propellers attached thereto.

Using a gear-driven transmission permits driving an automobile engine at the point of maximum horsepower, which generally implies a motor crank rotational speed approximately in the range of 5000–5200 rpm, and then gearing down the rotational speed to roughly 1000–1800 rpm, a significantly quieter speed at which to run the propellers. In addition, the use of a gear-based transmission permits driving counter-rotating propellers a different speeds if desired.

The invention is not, of course, limited to the use of an automobile engine; in fact, the use of gears enables the user to optimize for efficiency and noise characteristics by altering gear ratios as desired.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

A description of the preferred embodiments of the present invention will now be presented with reference to FIGS. 1–6.

Figure 1:
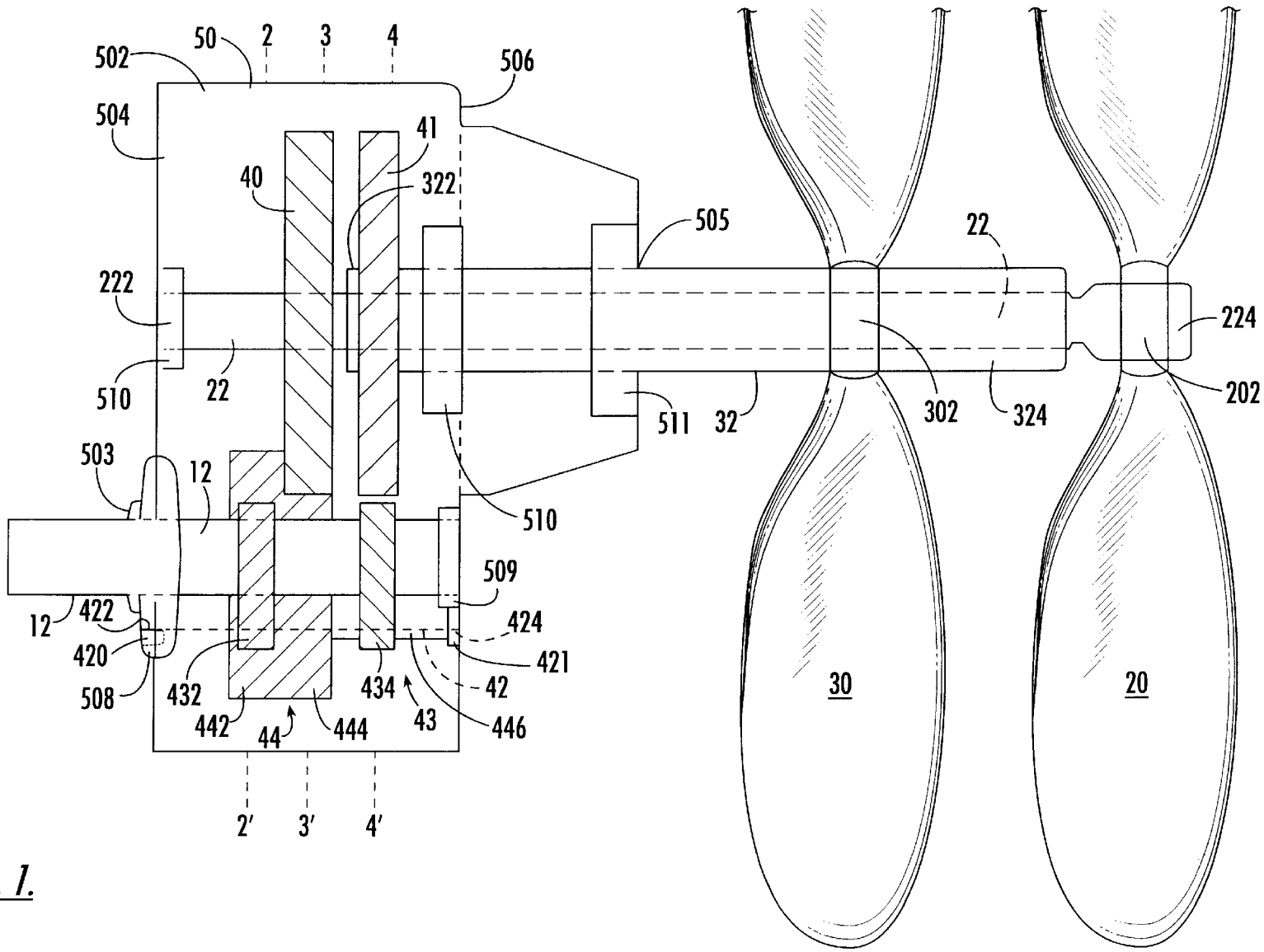
FIG. 1 illustrates a side cross-sectional view of a first embodiment of the airboat transmission.
Figure 5:
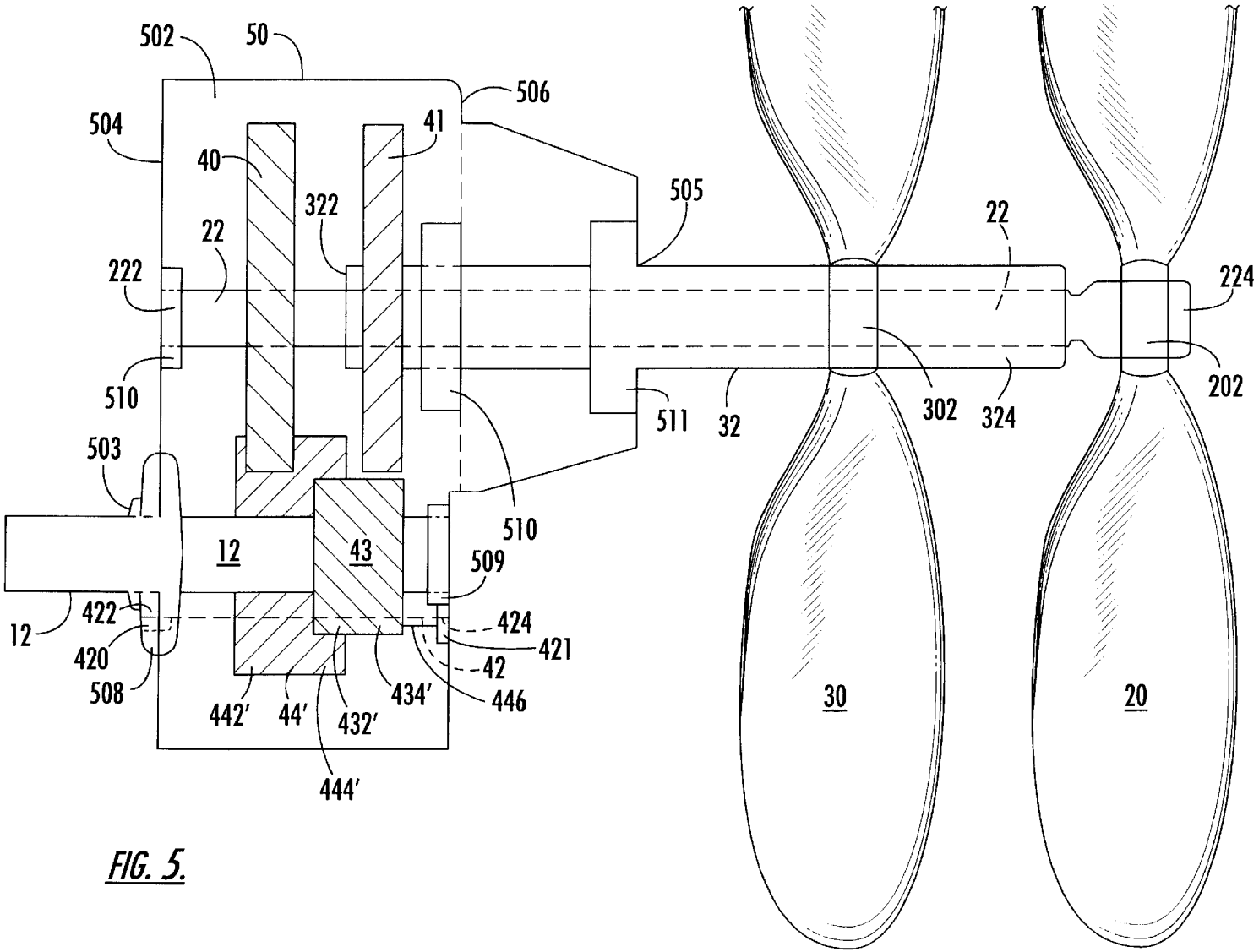
FIG. 5 illustrates a side cross-sectional view of a second embodiment of the airboat transmission.

The two embodiments of the airboat transmission 10 and 10' of the present invention to be discussed herein are shown from the side in FIGS. 1 and 5 and are designed to drive a pair of coaxial, counter-rotating propellers 20 and 30. The transmission comprises a housing 50 that has an interior space 502, a fore side 504, and an opposed aft side 506. The fore side 504 is affixable to the engine's bell housing, or may be an integral part thereof. The aft side 506 has an opening 505 for admitting propeller shafts 22,32; the fore side 504 has an opening 503 for admitting a drive shaft 12. It is preferred that the housing's exterior be aerodynamically shaped in order to confer good airflow characteristics to the transmission 10 and to the propellers 20,30 during use at high speeds.

The drive shaft 12 extends into the interior space 502 of the housing 50 through the fore side 504. The drive shaft 12 is rotatable in a first direction. The drive shaft 12 is preferably configured as a "through" shaft with respect to the housing 50, and is thus rotatably supportable via bearings and brackets 508,509 affixed on the inside of both the fore 504 and the aft 506 sides, respectively, of the housing's interior space 502. This dual support of all gears and shafts confers exceptional stability to the system 10.

The outer propeller 20 is mounted via propeller mount 202 to the aft portion 224 of, and is rotated by, an inner shaft 22, which in a preferred embodiment is hollow, that extends from the aft side 506 into the interior space 502 of the housing 50. The fore end 222 of the inner shaft 22 is rotatably supported via a bearing and bracketing 510 on the inside of the housing's fore side 504.

The inner propeller 30 is mounted via propeller mount 302 to the distal portion 324 of, and is rotated by, a hollow outer shaft 32 that extends from the aft side 506 into the interior space 502 of the housing 50. The outer shaft 32 is shorter than and is positioned in surrounding, generally coaxial arrangement to the inner shaft 22. These relative lengths permit the fore end 222 and the aft portion 224 of the inner shaft 22 to protrude, respectively, beyond the fore end 322 and the aft portion 324 of the outer shaft 32. The outer shaft 32 is supported on the interior of the housing's aft side 506 by two bearings and bracketing 510,511.

Figure 2:
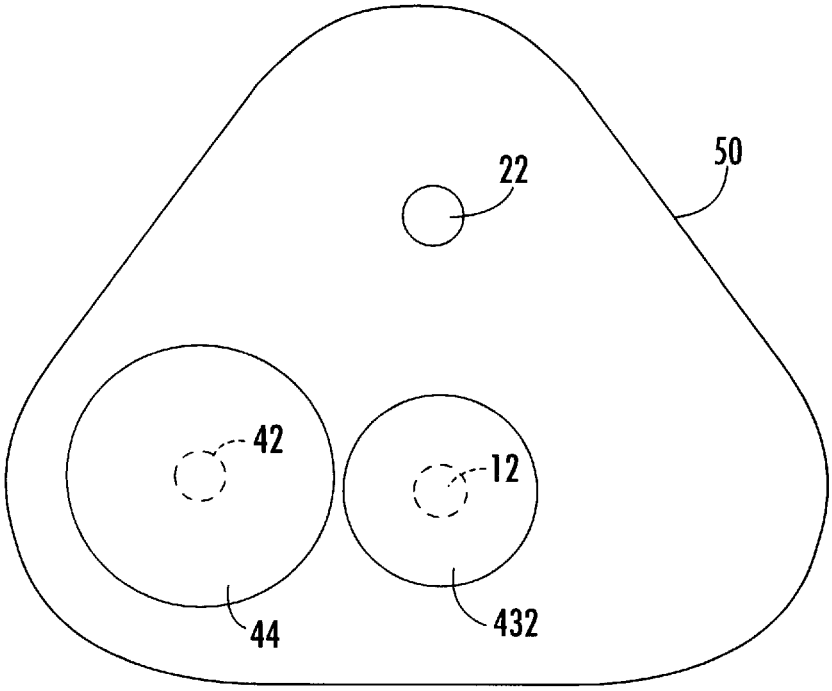
FIG. 2 illustrates an axial cross-sectional view the embodiment of FIG. 1, taken through line 2—2'.
Figure 3:
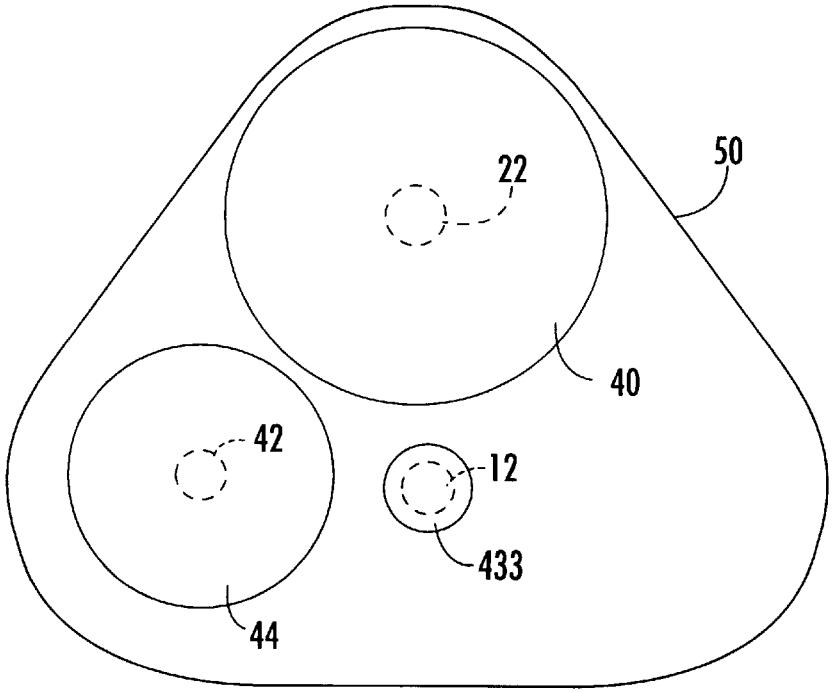
FIG. 3 illustrates an axial cross-sectional view the embodiment of FIG. 1, taken through line 3—3'.
Figure 4:
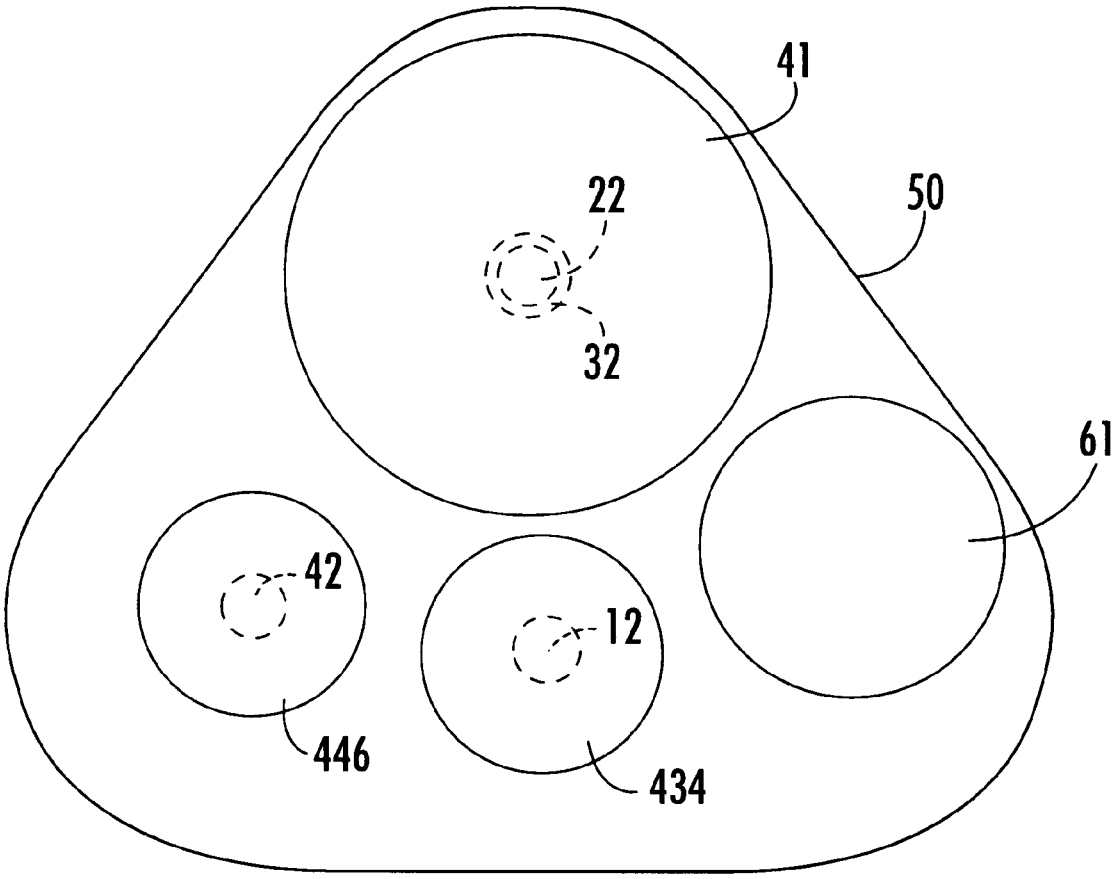
FIG. 4 illustrates an axial cross-sectional view the embodiment of FIG. 1, taken through line 4—4'.

In a preferred embodiment, as shown in FIGS. 2–4, the longitudinal axes of the drive shaft 12 and the inner 22 and outer 32 shafts are positioned generally in vertical alignment when the transmission 10 is substantially level. This positioning confers improved stability during use, as the gyroscopic forces balance in this configuration, which reduces torque and improves performance.

The airboat transmission of the present invention further comprises a gear system within the housing 50 for driving the shafts 22,32. Both of the embodiments 10,10' shown in FIGS. 1–5 contain four gears: a fore output gear, an aft output gear, an intermediate gear, and a drive gear. The configurations and shapes of these gears have been optimized for minimum volume and maximum stability and are believed to represent a considerable improvement in efficiency and wear characteristics over airboat transmissions previously known in the art.

Three common elements of the two embodiments are: a fore output gear 40, an aft output gear 41, and an intermediate gear shaft 42. The fore output gear 40 is affixed to the inner shaft 22 adjacent the fore end 222 for imparting rotational motion thereto. The aft output gear 41 is affixed to the outer shaft 32 coaxially with the inner shaft 22 adjacent the fore end 322 for imparting rotational motion thereto. The aft output gear 41 is generally coaxial with the fore output gear 40.

The intermediate gear shaft 42 has a fore end 422 and an aft end 424, which are opposedly affixed for rotation, respectively, to the inside of the fore 504 and aft 506 sides of the housing 50 via bearings and bracketing 420,421. The "through" nature of this shaft 42 confers exceptional stability to the transmission, which has not been achieved with previously known designs.

Airboat Transmission First Embodiment

In a first embodiment of the airboat transmission of the present invention, illustrated in FIGS. 1–4, the drive gear 43, which is mounted for rotation upon the drive shaft 12 within the housing interior space 502, comprises three sections: a fore drive gear 432, a central generally tubular portion 433 aft of the fore drive gear 432, and an aft drive gear 434 aft of the central portion 433. The fore 432 and the aft 434 drive gears each has a diameter larger than that of the central portion 433. The aft drive gear 434 is dimensioned and positioned, by being axially and radially adjacent, for driving the aft output gear 41 in an opposite sense from the incoming rotational direction. The fore drive gear 432 is axially positioned in spaced relation to, and thus is not in position to drive, the fore output gear 40. The central portion 433 is radially coplanar with and in spaced relation to the fore output gear 40, and thus can be seen to serve as a "spacer" between the drive gear sections 432,434.

An intermediate gear 44, which is mounted for rotation on the intermediate gear shaft 42, is dimensioned and positioned for being driven by the fore drive gear 432 and for driving the fore output gear 40, thus preserving the rotational direction of the former to the latter. In this embodiment the intermediate gear 44 comprises a fore gear section 442 having a diameter and a width sufficiently large to engage the fore drive gear 432 and an aft gear section 444 having a diameter and a width sufficiently large to engage the fore output gear 40. The intermediate gear 44 further comprises a generally tubular aft portion 446 having a diameter smaller than that of the fore gear section 442. The aft portion 446 is positioned radially coplanar with the drive gear central portion 433 and in spaced relation therefrom. The aft portion 446 is further positioned axially in spaced relation from the aft output gear 41 and aft drive gear 434 and thus is in driving relation to neither.

The intermediate gear 44 design and positioning permits the improved compactness of the present system 10, since it obviates the need for additional planetary gears as disclosed in previous gear-based transmissions known in the art.

Additionally, it is known that, when gears are in use, there is a force component tending to drive the gears apart, causing a portion of this component to be experienced by the gear support shaft. The intermediate gear 44 of the present invention, since it is interacting with two other gears, experience a net force component from those two other gears, which makes the ability to mount the intermediate gear 44 on a through shaft 42 even more important. Similarly, the drive gear 43 and the output gears 40,41 also experience exceptional stability owing to their being mounted on through shafts supported at both ends.

Airboat Transmission Second Embodiment

Figure 6:
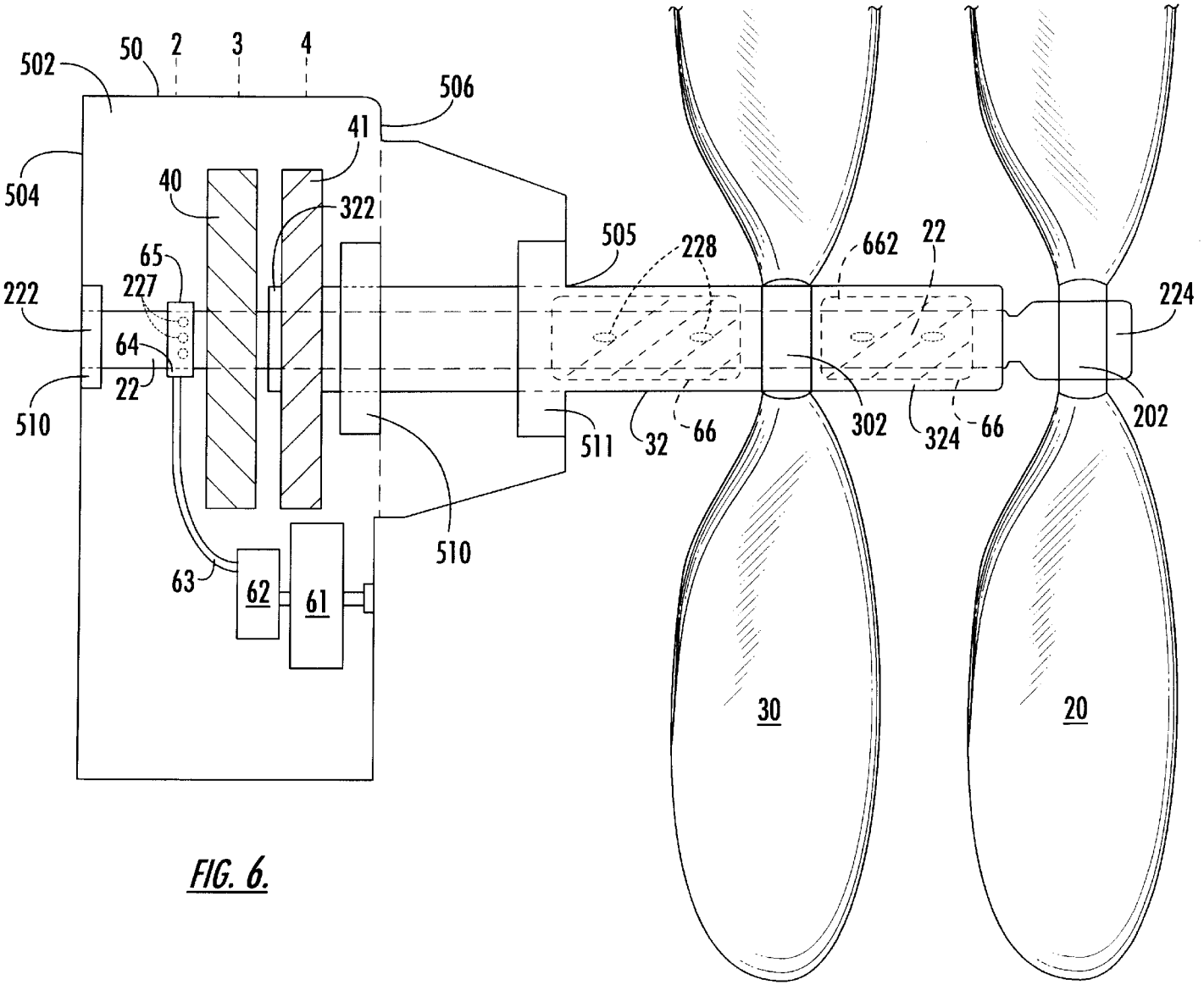
FIG. 6 illustrates a side cross-sectional view of the lubrication portion of the airboat propulsion system.

In a second embodiment of the airboat transmission of the present invention, illustrated in FIG. 6, the drive gear 43' is mounted for rotation upon the drive shaft 12 within the housing interior space 502. As compared with the drive gear 43 of the first embodiment, drive gear 43' is wider so that it can drive both the aft output gear 41 and the intermediate gear 44'. Its aft portion 434' is dimensioned and positioned, by being axially and radially adjacent, for driving the aft output gear 41 in an opposite sense from the incoming rotational direction. Its fore portion 432' is axially positioned in spaced relation to, and thus is not in position to drive, the fore output gear 40. The drive gear 43' obviously has a diameter larger than that of the drive shaft 12, on which it is mounted. A portion of the drive shaft 12 fore of the drive gear 43' is radially coplanar with and in spaced relation to the fore output gear 40, and thus is not in driving relation thereto.

The intermediate gear 44', which is mounted on the intermediate gear shaft 42, is dimensioned and positioned for being driven by the fore portion 432' of the drive gear 43' and for driving the output gear 40, thus preserving the rotational direction of the former to the latter. In this embodiment the intermediate gear 44' comprises an aft gear section 444' having a diameter and a width sufficiently large to engage the fore portion 432' of the drive gear 43' and a fore gear section 442' having a diameter and width sufficiently large to engage the fore output gear 40. The intermediate gear 44' further comprises a generally tubular aft portion 446' having a diameter smaller than that of the fore gear section 442'. The aft portion 446' is positioned radially coplanar with the aft output gear 41 and in spaced relation therefrom.

The combination of radial and axial spacings of the above-listed components, which are illustrated in side cross-section in FIGS. 1 and 5 and in axial cross-sections in FIGS. 2–4, permits an optimized, compact arrangement of a minimum number of gears within the housing 50. Compactness and lower weight translate into improved efficiency in terms of fuel efficiency and better wear characteristics. It has been estimated that an increase of 25–30% in fuel efficiency will be attained, as well as a 50% increase in engine life. Further, there is significantly less noise produced.

In either of the above-detailed embodiments or their equivalents it may be seen that the gear system can be adapted to drive the propellers at different speeds, which has been shown to provide improved thrust characteristics and reduced noise. In a particular embodiment the gear ratios vary so that the propeller velocity ratio ranges from 0.85:1 to 1:0.85. In a preferred embodiment the velocity of the outer propeller 20 is greater than that of the inner 30 by a ratio of 1:0.85. This gearing allows for a velocity gain, as the air for the inner propeller 30 is accelerated toward the outer propeller 20, which makes it advantageous to rotate the outer propeller 20 at a higher speed to "catch" faster-moving air.

Airboat Propulsion Lubrication System

An additional aspect of the present invention comprises a lubrication system for delivering lubricant to the elements of the propulsion system. A particular element of the lubrication system illustrated in FIG. 6, comprises a lubrication driving gear 61, which is positioned for being driven by the aft output gear 41 (see FIG. 4). The motion of the lubricating output gear 61 drives lubricant from the well 62, which is positioned adjacent the gear 61, through tubing 63, and through a hole 64 in collar 65 into the interior thereof. Collar 65 is believed to represent a novel advance, and is positioned in surrounding relation adjacent the fore end 222 of the inner shaft 22, between the fore side 504 of the housing 50 and the fore output gear 40. Collar 65 floats on the inner shaft 22, which has a plurality of holes 227 beneath the collar 65. The holes 227 enable lubricant to be delivered under pressure via a substantially stationary element (the collar 65) to a rotating body (the inner shaft 22).

Lubricant proceeds from the holes 227 into the interior of the inner shaft 22 and in a generally aft direction, and then out through holes 228 in the aft portion of the shaft 22 to enter the space between the shafts 22,32, where there are positioned a plurality of floating cylindrical bearings 66, which maintain the distance between the shafts 22,32 and also assist to distribute lubricant. In a preferred embodiment there are three of these bearings 66 positioned in spaced relation from each other along the shafts 22,32 (two are shown in FIG. 6), and the material comprises brass.

The bearings 66 themselves represent a novel lubrication element, being designed to maximize lubricant return in the fore direction. In a preferred embodiment each bearing 66 has a series of generally helical grooves 662 cut in the outer surface, through which the lubricant may return toward the source.

It may be appreciated by one skilled in the art that additional embodiments may be contemplated, including variable numbers and sizes of gears, which may be positioned and configured to permit variable relative speeds of the two counter-rotating propellers.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. An airboat transmission for converting an engine drive shaft rotation into coaxial counter-rotations for driving a pair of airboat propellers, the transmission comprising:

a fore output gear rotatably affixable within a housing and affixable to an inner shaft for rotating an outer propeller of an airboat;

an aft output gear rotatably affixable within the housing and affixable to a hollow outer shaft coaxial with the inner shaft for rotating an inner propeller of an airboat, the aft output gear coaxial with the fore output gear;

an intermediate gear shaft having a fore end and an aft end, both ends opposedly and rotatably affixable within the housing;

an intermediate gear mounted on the intermediate gear shaft, the intermediate gear positioned in driving relation to the fore output gear; and a drive gear rotatably affixable within the housing and affixed for corotation with the drive shaft, the drive gear having a fore portion positioned in driving relation to the intermediate gear and an aft portion positioned in driving relation to the aft output gear.

2. The airboat transmission recited in claim 1, wherein:

the drive gear further has a central portion having a diameter smaller than a diameter of the fore and the aft portions, the central portion positioned axially between the fore and the aft portions and radially coplanar with and in spaced relation to the fore output gear; and the intermediate gear is positioned axially in spaced relation from the aft output gear and the aft drive gear.

3. The airboat transmission recited in claim 2, further comprising intermediate gear shaft fore and aft bearing means for rotatably affixing the fore and aft ends of the intermediate gear shaft to the housing.

4. The airboat transmission recited in claim 1, further comprising inner shaft bearing means for rotatably affixing a fore end of the inner shaft to the housing.

5. The airboat transmission recited in claim 1, further comprising a cylindrical floating bearing positionable in surrounding relation to the inner shaft and between the inner shaft and the outer shaft for maintaining a distance therebetween and further for assisting to distribute lubricant therebetween.

6. The airboat transmission recited in claim 1, wherein the floating bearing has a generally helical groove in an outer surface for assisting in returning lubricant in a fore direction.

7. The airboat transmission recited in claim 1, wherein:

the drive gear is positioned axially in spaced relation to the fore output gear; and the intermediate gear is positioned axially in spaced relation to the aft output gear.

8. The airboat transmission recited in claim 1, wherein the fore and the aft output gear have diameters dimensioned to produce an inner-to-outer propeller rotational velocity ratio in a general range of from 1:0.85 to 0.85:1.0.

9. The airboat transmission recited in claim 1, further comprising:

means for rotatably supporting the drive shaft within an interior space of the housing; and means for rotatably supporting the inner and the outer shafts within the interior space of the housing.

10. An airboat transmission for converting an engine drive shaft rotation into coaxial counter-rotations for driving a pair of airboat propellers, the transmission comprising:

a fore output gear rotatably affixable within a housing and affixable to an inner shaft for rotating an outer propeller of an airboat;

an aft output gear rotatably affixable within the housing and affixable to a hollow outer shaft coaxial with the inner shaft for rotating an inner propeller of an airboat, the aft output gear coaxial with the fore output gear;

an intermediate gear rotatably mounted within the housing, the intermediate gear positioned in driving relation to the fore output gear and axially in spaced relation to the aft output gear and the aft drive gear; and a drive assembly comprising an aft drive gear, a generally cylindrical drive gear post, and a fore drive gear, all rotatably and coaxially affixable within the housing and affixable for corotation with the drive shaft, the fore drive gear positioned in driving relation to the intermediate gear, the aft gear positioned in driving relation to the aft output gear, and the drive gear post having a smaller diameter than a diameter of either the aft or the fore drive gear and positioned axially between the fore and the aft drive gears and axially coplanar with and radially in spaced relation to the fore output gear.

11. The airboat transmission recited in claim 10, further comprising an intermediate gear shaft having a fore end and an aft end, both ends opposedly and rotatably affixable within the housing, the intermediate gear mounted thereon.

12. An airboat transmission for converting an engine drive shaft rotation into coaxial counter-rotations for driving a pair of airboat propellers, the transmission comprising:

a housing having an interior space, a fore side, and an aft side opposed to the fore side, the fore side affixable to an engine bell housing, an opening in the aft side for permitting a pair of coaxial propeller shafts to pass therethrough, and an opening in the fore side for permitting a drive shaft to pass therethrough;

a fore output gear rotatably affixable within the housing interior space and affixable to an inner shaft for rotating an outer propeller of an airboat;

an aft output gear rotatably affixable within the housing interior space and affixable to a hollow outer shaft coaxial with the inner shaft for rotating an inner propeller of an airboat, the aft output gear coaxial with the fore output gear;

an intermediate gear shaft having a fore end and an aft end, the fore and the aft ends opposedly and rotatably affixable within the housing interior space to the housing fore side and aft side, respectively;

an intermediate gear mounted on the intermediate gear shaft, the intermediate gear positioned in driving relation to the fore output gear; and a drive gear rotatably affixable within the housing interior space and affixed for corotation with the drive shaft, the drive gear having a fore portion positioned in driving relation to the intermediate gear and an aft portion positioned in driving relation to the aft output gear.

13. The airboat transmission recited in claim 12, wherein:

the drive gear further has a central portion having a diameter smaller than a diameter of the fore and the aft portions, the central portion positioned axially between the fore and the aft portions and radially coplanar with and in spaced relation to the fore output gear; and the intermediate gear is positioned axially in spaced relation from the aft output gear and the aft drive gear.

14. The airboat transmission recited in claim 12, wherein:

the drive gear is positioned axially in spaced relation to the fore output gear; and the intermediate gear is positioned axially in spaced relation to the aft output gear.

15. An airboat propulsion system comprising:

an inner shaft for rotating an outer propeller of an airboat;

a hollow outer shaft coaxial with the inner shaft for rotating an inner propeller of an airboat;

a fore output gear rotatably affixable within a housing and affixable to the inner shaft;

an aft output gear rotatably affixable within the housing and affixable to the outer shaft, the aft output gear coaxial with the fore output gear;

an intermediate gear shaft having a fore end and an aft end, both ends opposedly and rotatably affixable within the housing;

an intermediate gear mounted on the intermediate gear shaft, the intermediate gear positioned in driving relation to the fore output gear; and a drive gear rotatably affixable within the housing and affixed for corotation with an engine drive shaft, the drive gear having a fore portion positioned in driving relation to the intermediate gear and an aft portion positioned in driving relation to the aft output gear.

16. The airboat propulsion system recited in claim 15, wherein the inner shaft is hollow.

17. The airboat propulsion system recited in claim 15, further comprising cylindrical floating bearing means positioned in surrounding relation to the inner shaft and between the inner shaft and the outer shaft for maintaining a distance therebetween and further for assisting to distribute lubricant therebetween.

18. The airboat propulsion system recited in claim 17, wherein the floating bearing has a generally helical groove in an outer surface for assisting in returning lubricant in a fore direction.

19. The airboat propulsion system recited in claim 15, wherein the inner shaft and the outer shaft are positioned generally in vertical alignment with the drive shaft for increasing stability.

20. The airboat propulsion system recited in claim 15, further comprising a lubrication system comprising:

a lubrication system gear affixed for rotation within the housing in a position for being driven by the drive gear;

a lubricant well for housing lubricant;

means in fluid communication with the well for delivering lubricant to a space between the inner and the outer shafts;

means for converting a rotational motion of the lubrication system gear into a motive force for moving lubricant out of the well, through the lubricant delivery means, and into the shaft space.

21. The airboat propulsion system recited in claim 20, further comprising cylindrical floating bearing means positioned in surrounding relation to the inner shaft and between the inner shaft and the outer shaft for maintaining a distance therebetween and further for assisting to distribute lubricant therebetween.

22. The airboat propulsion system recited in claim 21, wherein the floating bearing has a generally helical groove in an outer surface for assisting in returning lubricant in a fore direction.

23. A method for improving the efficiency and lowering the noise output of an airboat comprising the steps of:

providing an airboat propulsion system comprising:

an inner shaft for rotating an outer propeller of an airboat;

a hollow outer shaft coaxial with the inner shaft for rotating an inner propeller of an airboat;

a fore output gear rotatably affixable within a housing and affixable to the inner shaft;

an aft output gear rotatably affixable within the housing and affixable to the outer shaft, the aft output gear coaxial with the fore output gear;

an intermediate gear shaft having a fore end and an aft end, both ends opposedly and rotatably affixable within the housing;

an intermediate gear mounted on the intermediate gear shaft, the intermediate gear positioned in driving relation to the fore output gear; and a drive gear rotatably affixable within the housing and affixed for corotation with the drive shaft, the drive gear having a fore portion positioned in driving relation to the intermediate gear and an aft portion positioned in driving relation to the aft output gear; and utilizing the propulsion system to drive a pair of propellers in counter-rotating motion.

24. The method recited in claim 23, wherein the fore and the aft output gear have diameters dimensioned to produce an inner-to-outer propeller rotational velocity ratio in a general range of from 1:0.85 to 0.85:1.0.

25. A method for making an airboat transmission comprising the steps of:

rotatably affixing a fore output gear within a housing and to an inner shaft for rotating an outer propeller of an airboat;

rotatably affixing an aft output gear within the housing and to a hollow outer shaft coaxial with the inner shaft for rotating an inner propeller of an airboat, the aft output gear coaxial with the fore output gear;

opposedly affixing a fore end and an aft end of an intermediate gear shaft for rotation within the housing;

mounting an intermediate gear on the intermediate gear shaft in driving relation to the fore output gear; and rotatably affixing a drive gear within the housing for corotation with the drive shaft, a fore portion thereof positioned in driving relation to the intermediate gear and an aft portion thereof positioned in driving relation to the aft output gear.

* * * * *

UNITED STATES PATENT AND TRADEMARK OFFICE
CERTIFICATE OF CORRECTION

PATENT NO : 6,053,782
DATED : April 25, 2000
INVENTOR(S) : W. Bishop Jordan

It is certified that an error appears in the above-identified patent and that said Letters Patent are hereby corrected as shown below:

In the Title Page: After "[73] Assignee: Louis A. Bell"

Please insert --, part interest--

Signed and Sealed this

Tenth Day of April, 2001

*Attest:*

Nicholas P. Godici

NICHOLAS P. GODICI

*Attesting Officer*

*Acting Director of the United States Patent and Trademark Office*